United States Patent [19]

Kasprow

[11] 3,972,645

[45] Aug. 3, 1976

[54] PLATFORM SEAL-TANGENTIAL BLADE

[75] Inventor: Robert Felix Kasprow, Wethersfield, Conn.

[73] Assignee: United Technologies Corporation, Hartford, Conn.

[22] Filed: Aug. 4, 1975

[21] Appl. No.: 601,741

[52] U.S. Cl. ..... 416/215; 416/193 A; 416/218

[51] Int. Cl.[2] ..... F01D 5/30

[58] Field of Search ..... 416/215–218, 416/193 A, 190

[56] References Cited

UNITED STATES PATENTS

| | | | |
|---|---|---|---|
| 1,003,892 | 9/1911 | Farquhar | 416/215 |
| 1,276,405 | 8/1918 | Parsons et al. | 416/190 |
| 2,299,429 | 10/1942 | Rydmark | 416/190 |
| 3,367,629 | 2/1968 | Partington | 416/190 |
| 3,503,696 | 3/1970 | Bauger et al. | 416/193 A X |

*Primary Examiner*—Everette A. Powell, Jr.
*Attorney, Agent, or Firm*—Charles A. Warren

[57] ABSTRACT

In an axial flow compressor rotor stage having a tangential slot in the periphery of the rotor to receive the blade roots, a seal is positioned below the blade platforms to seal these platforms against air recirculation. The seal extends under the platforms of several blades and is ladder shaped with the rungs sealing the platform spaces and the struts serving to interconnect and hold the rungs in place.

5 Claims, 4 Drawing Figures

PLATFORM SEAL-TANGENTIAL BLADE

BACKGROUND OF THE INVENTION

Improvements in compressor performance depend in many cases in reducing air recirculation at any points in the compressor where such recirculation occurs. One of these places is between adjacent blade platforms on the periphery of the rotor, since the blade platforms must have a small space between them. Seals for these clearance spaces are difficult to position in such a manner as to be effective without being expensive and such seals must remain in position for the life of the rotor on which they are positioned. The best type of seal is one that requires a minimum of parts and a minimum of assembly problems.

SUMMARY OF THE INVENTION

According to the present invention the space between the blade platforms is sealed by a thin sheet metal seal positioned beneath the platforms and held against the platforms by centrifugal force when the compressor is in operation. The seal is preferably a ring extending around the periphery of the rotor with aligned holes to receive the roots of adjacent blades, these aligned holes defining crossbars or rungs interconnected by circumferential strips interconnecting the ends of the crossbars and also underlying the platforms. The circumferential strips space the crossbars properly to be positioned beneath the slots between adjacent platforms and permit a plurality of crossbars to be integrally connected together.

The foregoing and other objects, features, and advantages of the present invention will become more apparent in the light of the following detailed description of preferred embodiments thereof as illustrated in the accompanying drawing.

DESCRIPTION OF THE PREFERRED EMBODIMENT

Figure 1:
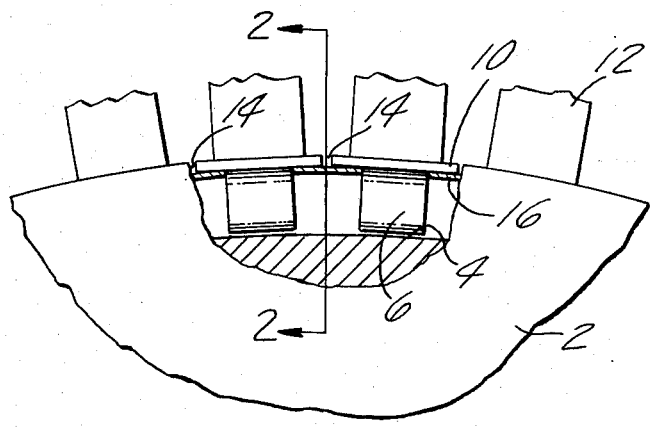
FIG. 1 is an elevation of a portion of a compressor rotor with parts broken away.
Figure 2:
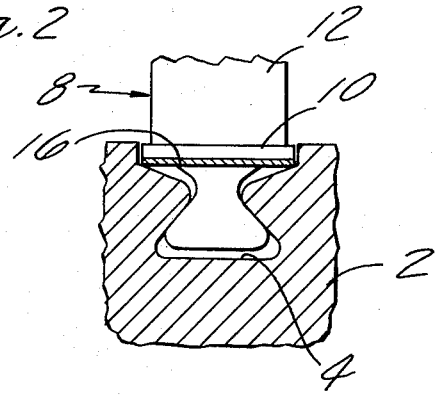
FIG. 2 is a section along line 2—2 of FIG. 1.

As shown in FIGS. 1 and 2, the compressor rotor 2 has a circumferential root retaining slot 4 in its periphery, this slot being shaped to receive the blade roots 6, preferably dovetail in shape. Each blade 8 carried by the associated root has a platform 10 overlying the periphery of the rotor, the operative portion 12 of the blade extending radially outward from the platform.

Figure 3:
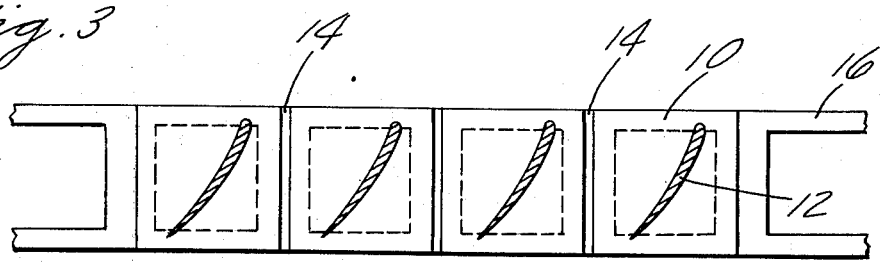
FIG. 3 is a developed view of the seal in position.

Adjacent platforms 10 are slightly spaced apart circumferentially for the purpose of assembly, thermal expansion, and efficient operation, leaving a narrow slot 14 as shown in FIGS. 1 and 3. Unless this slot is closed during compressor operation there may be air recirculation in this area introducing losses that detrimentally affect the compressor operation and efficiency. The problem is to close these slots effectively and inexpensively so that air recirculation in this location is avoided.

Figure 4:
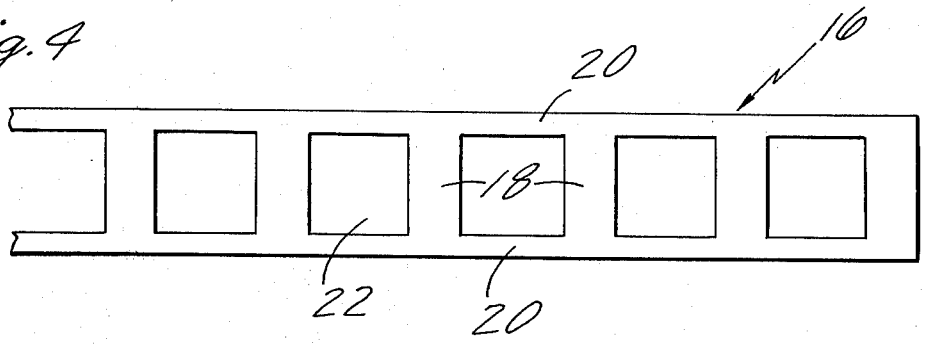
FIG. 4 is a view of the seal strip.

To accomplish this a seal 16 as shown in FIG. 4 is used. This seal has circumferentially spaced crossbars 18 interconnected at opposite ends by longitudinally extending strips 20 integral with the crossbars at the ends. This structure may be formed by punching a series of longitudinally-spaced openings 22 in a strip of sheet metal. These openings, large enough to accept the blade root, are preferably rectangular or square as shown and, when punches in the strip of sheet metal define the crossbars and interconnecting strips. Obviously, the spacing of the openings is such that the crossbars are spaced to correspond to the circumferential spacing of the slots between the platforms. The strip is preferably substantially the width of the blade platforms so that the longitudinal strips underlie the platforms adjacent opposite edges.

In forming the rotor the slot 4 is preferably embedded in the periphery of the rotor to such an extent that the outer surfaces of the platforms will be substantially coextensive with the surface of the rotor and thus both the blade platforms and the seal will be below the peripheral surface of the rotor. With adequate clearance for each blade root in the associated opening in the seal strip it will be clear that the strip will be urged by centrifugal force against the underside of the blade platforms when the compressor is in operation, so that the crossbars effectively seal the slots 14. As shown each seal strip extends under several blade platforms and may extend as much as one-half the rotor circumference.

In assembly, the seal strip is positioned as the blades are assembled on the rotor, each blade root being inserted in the appropriate opening in the strip and then blades and strip moved circumferentially around the rotor, the blade roots being in the slot 4. The seal strip, as shown, is thinner than the space between the underside of the blade platform and the bottom of the portion of the slot 4 that accommodates the blade platforms so there is a slight freedom of radial movement of the strip beneath the platforms. This clearance also permits easier assembly of the blades on the rotor.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of my invention, that which I claim as new and desire to secure by Letters Patent of the United States is:

1. A rotor construction including a disk having a blade root retaining slot extending circumferentially on the periphery of the disk, a plurality of blades mounted on the periphery of the disk, each blade having a root received in the slot, each of said blades having a platform thereon overlying the peripheral surface of the disk and an operative portion extending outward from the platform, each platform extending toward the platforms on adjacent blades into closely spaced relation to the adjacent platforms, said platforms extending axially beyond the blade roots, in combination with a seal in the form of a ring underlying a plurality of adjacent platforms and positioned between the periphery of the disk and the blade platforms and substantially as wide as the axial dimension of the platforms, said seal having spaced openings between opposite edges of the ring and each larger than the blade root therein to accept and fit around the roots adjacent to the associated platforms beneath which the seal is positioned, the material of the seal between the openings forming crossbars so spaced as to underlie and close the space between the platforms on adjacent disks, said crossbars extending between circumferentially extending elements of the seal located on opposite sides of the roots, these elements serving to hold the crossbars in proper circumferential spacing and said ring being held in sealing position by centrifugal force when the rotor is rotating and being otherwise unattached to disk or blades.

2. A rotor construction as in claim 1 in which the spaced openings in the strip are larger than the roots on the blades to be freely movable thereon.

3. A rotor construction as in claim 1 in which the seal is thinner than the radial space beneath the platforms and the periphery of the disk adjacent thereto for movement relative thereto.

4. A rotor construction as in claim 1 in which the seal extends peripherally along the surface of the disk, on both sides of the blade roots and beneath the edges of the blade platforms.

5. The combination with a bladed rotor of a sheet material seal strip for closing the clearance slots between the adjacent blade platforms on the bladed rotor, the blades having roots fitting in a peripheral slot in the rotor, platforms on said blades radially outward of the roots and overlying a portion of the periphery of the rotor, and operative blade portions extending radially outward from the platforms, each platform extending circumferentially toward the adjacent platform into closely spaced relation thereto to define the clearance slots, said seal strip including crossbars spaced to correspond to the spacing of the clearance slots and longitudinal strips connecting the crossbars and integral with and at opposite ends of the crossbars, the spacing of the longitudinal strips corresponding to the width of the blade platforms so as to extend to the edges thereof, said strips and crossbars defining spaced substantially rectangular openings in the sheet seal spaced to correspond to the spacing of the blades in the rotor and large enough to receive a blade root freely in each opening, said seal strip being positioned beneath the blade platforms on the periphery of the rotor with the crossbars located beneath the clearance slots.

* * * * *